US005238779A

United States Patent [19]

Adin et al.

[11] Patent Number: 5,238,779

[45] Date of Patent: Aug. 24, 1993

[54] NUCLEATED HIGH CONTRAST PHOTOGRAPHIC ELEMENTS CONTAINING LOW-STAIN SENSITIZING DYES

[75] Inventors: Anthony Adin; Linda J. Knapp; Steven G. Link, all of Rochester, N.Y.

[73] Assignee: Eastman Kodak Company, Rochester, N.Y.

[21] Appl. No.: 735,484

[22] Filed: Jul. 25, 1991

[51] Int. Cl.[5] ..... G03C 1/06

[52] U.S. Cl. ..... 430/264; 430/603; 430/604; 430/605; 430/588; 430/598; 430/567; 430/581; 430/550

[58] Field of Search ..... 430/264, 603, 604, 605, 430/588, 598, 567, 581, 550

[56] References Cited

U.S. PATENT DOCUMENTS

| | | | |
|---|---|---|---|
| H583 | 2/1989 | Asami . | |
| 2,912,329 | 11/1959 | Jones et al. | 430/550 |
| 3,397,060 | 7/1968 | Schwan et al. | 430/550 |
| 3,615,642 | 1/1971 | Ficken et al. | 430/588 |
| 3,706,570 | 12/1972 | Nakazawa et al. | 430/588 |
| 3,793,020 | 2/1974 | Kimura et al. | 430/588 |
| 4,040,841 | 12/1977 | Hinata et al. | 430/550 |
| 4,510,235 | 4/1985 | Ukai et al. | 430/574 |
| 4,555,481 | 11/1985 | Ukai et al. | 430/588 |
| 4,686,167 | 8/1987 | Resnick et al. | 430/264 |
| 4,810,626 | 3/1989 | Burgmaier et al. | 430/603 |
| 4,837,140 | 6/1989 | Ikeda et al. | 430/550 |
| 4,975,354 | 12/1990 | Machonkin et al. | 430/264 |
| 4,988,604 | 1/1991 | Machonkin et al. | 430/264 |
| 5,041,355 | 8/1991 | Machonkin et al. | 430/264 |
| 5,049,484 | 9/1991 | Deaton | 430/605 |
| 5,049,485 | 9/1991 | Deaton | 430/605 |
| 5,126,227 | 6/1992 | Machonkin et al. | 430/264 |

*Primary Examiner*—Charles L. Bowers, Jr.
*Assistant Examiner*—Thomas R. Neville
*Attorney, Agent, or Firm*—Alfred P. Lorenzo

[57] ABSTRACT

Silver halide photographic elements which are capable of high-contrast development and are especially useful in the field of graphic arts comprise surface latent image forming high-chloride silver halide grains and have incorporated therein a hydrazine compound which functions as a nucleator, an amino compound which functions as an incorporated booster, and a benzimidazolocarbocyanine sensitizing dye that provides enhanced photographic sensitivity yet leaves substantially no sensitizing dye stain after rapid access processing.

24 Claims, No Drawings

NUCLEATED HIGH CONTRAST PHOTOGRAPHIC ELEMENTS CONTAINING LOW-STAIN SENSITIZING DYES

FIELD OF THE INVENTION

This invention relates in general to photography and in particular to novel black-and-white photographic elements. More specifically, this invention relates to novel nucleated silver halide photographic elements which are capable of high contrast development and are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

Photographic elements of the type described in the aforesaid U.S. Pat. No. 4,975,354 are critically dependent on the use of sensitizing dyes. Silver halide crystals, such as silver chloride, silver bromide, silver iodide, silver chlorobromide and silver bromoiodide, absorb light in the ultraviolet and blue regions of the spectrum to form latent images that can be amplified by chemical development. To make the silver halide grains sensitive to wavelengths in other regions of the electromagnetic spectrum, it is well known to add spectral sensitizing dyes to the silver halide emulsion. These dyes are adsorbed to the surface of the silver halide crystals and must be efficient at absorbing incident light and transferring the energy to the silver halide. Furthermore, since these dyes do not form part of the final image, it is desirable that they be decolorized or removed from the photographic element during processing to avoid objectionable sensitizing dye stain.

Dye stain is a matter of particularly great concern with photographic elements used in the graphic arts industry. These photographic elements are processed to produce black-and-white images that are very high in contrast. Retained sensitizing dye causes discoloration of the white areas, and degrades the appearance and performance of the photographic elements.

In the graphic arts industry, it is also very important that photographic elements can be processed rapidly in order to provide enhanced efficiency and productivity. The use of very short development times, such as times of thirty to forty seconds or less, is commonly referred to in the trade as "rapid access processing". Elements which are capable of rapid access processing can be most easily achieved through the use of high-chloride emulsions, because such emulsions exhibit enhanced developability relative to bromide or iodide emulsions. However, efficient spectral sensitization of high-chloride emulsions is very difficult to achieve. Adsorption of spectral sensitizing dyes generally increases in the order silver chloride<silver bromide<silver iodide. Poor adsorption of sensitizing dye leads to loss of photographic speed. Dyes which are strongly adsorbed to silver chloride, on the other hand, frequently can not be removed during rapid processing, and cause objectionable levels of sensitizing dye stain. Accordingly, to achieve the advantages inherent in the use of high-chloride emulsions in photographic elements of the type described in U.S. Pat. No. 4,975,354, it is critically important to utilize a sensitizing dye meeting the dual objectives of excellent sensitizing capability with minimal tendency to cause stain.

It is toward the objective of providing improved nucleated, high-contrast, high-chloride photographic elements containing spectral sensitizing dyes that provide improved photographic sensitivity—yet leave substantially no sensitizing dye stain after rapid access processing—that the present invention is directed.

SUMMARY OF THE INVENTION

The present invention provides novel silver halide photographic elements which are adapted to form a high-contrast image when development is carried out with an aqueous alkaline developing solution. The novel photographic elements of this invention comprise:

(1) surface latent image forming high-chloride silver halide grains, (2) a hydrazine compound that functions as a nucleator, (3) an amino compound that functions as an incorporated booster, and (4) a benzimidazolocarbocyanine sensitizing dye having at least one acid-substituted alkyl group attached to a nitrogen atom of a benzimidazole ring.

Benzimidazolocarbocyanine sensitizing dyes having at least one acid-substituted alkyl group attached to a nitrogen atom of a benzimidazole ring provide enhanced photographic sensitivity in the photographic elements of this invention, yet leave substantially no sensitizing dye stain after rapid access processing. Preferred sensitizing dyes of this class are those of the formula:

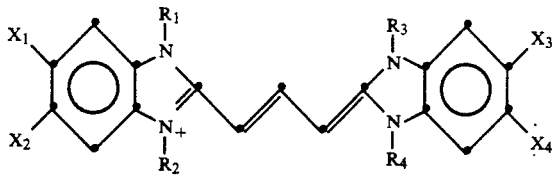

wherein $X_1$, $X_2$, $X_3$ and $X_4$ are, independently, hydrogen, cyano, alkyl, halo, haloalkyl, alkylthio, alkoxycarbonyl, aryl or substituted or unsubstituted carbamoyl;

$R_1$ and $R_3$ are alkyl;

$R_2$ and $R_4$ are, independently, alkyl, alkenyl, substituted alkyl or substituted alkenyl, with the proviso that at least one of $R_2$ and $R_4$ is acid-substituted alkyl, and with the further proviso that when both $R_2$ and $R_4$ are acid-substituted alkyl, there is also a cation present to balance the charge.

More particularly, $X_1$, $X_2$, $X_3$ and $X_4$ can be hydrogen, cyano, alkyl preferably containing 1 to 20 carbon atoms and more preferably 1 to 8 carbon atoms, halo such as chloro or bromo, haloalkyl such as trifluoromethyl or 2,2,2-trifluoroethyl, alkylthio such as methylthio or ethylthio, alkoxycarbonyl such as ethoxycarbonyl or propoxycarbonyl, aryl such as phenyl or naphthyl, carbamoyl or carbamoyl in which the nitrogen atom is substituted with one or two substituents such as methyl or ethyl groups;

$R_1$ and $R_3$ are alkyl, preferably containing 1 to 6 carbon atoms and more preferably 1 to 3 carbon atoms;

$R_2$ and $R_4$ can be alkyl preferably containing 1 to 20 carbon atoms and more preferably 1 to 8 carbon atoms, alkenyl preferably containing 1 to 20 carbon atoms and more preferably 1 to 8 carbon atoms, alkyl or alkenyl substituted with substituents such as halo, hydroxy, alkoxy, alkoxycarbonyl, carbamoyl or dialkylcarbamoyl, or acid-substituted alkyl such as carboxyalkyl, sulfoalkyl, sulfatoalkyl, thiosulfatoalkyl, sulfoalkylcarbamoylalkyl, phosphonoalkyl, phosphatoalkyl, acylsulfamoylalkyl or sulfonylcarbamoylalkyl. As indicated hereinabove, at least one of $R_2$ and $R_4$ must be acid-substituted alkyl. As also indicated hereinabove, when both $R_2$ and $R_4$ are acid-substituted alkyl, there must also be a cation present to balance the charge. Examples of suitable cations include sodium, potassium, triethylammonium and pyridinium.

Benzimidazolocarbocyanine sensitizing dyes having at least one acid-substituted alkyl group attached to a nitrogen atom of a benzimidazole ring have been found to provide outstanding performance in high contrast elements utilizing high-chloride emulsions, a hydrazine compound that functions as a nucleator and an amino compound that functions as an incorporated booster. For example, these dyes provide high sensitivity and contrast, very low retained dye stain and excellent safelight sensitivity. They function effectively with high-chloride emulsions and thereby permit the use of the rapid access processing that is rendered feasible by the enhanced developability which high-chloride emulsions provide.

Benzimidazolocarbocyanine dyes have been used heretofore as sensitizing dyes in photographic elements. (See, for example, U.S. Pat. Nos. 2,912,329, 3,706,570, 4,040,841, 4,510,235, 4,837,140 and 4,975,354). However, use of benzimidazolocarbocyanine sensitizing dyes having at least one acid-substituted alkyl group attached to a nitrogen atom of a benzimidazole ring in high contrast black-and-white elements for the graphic arts industry of the type described herein has not been known heretofore, and in these products, they provide important unexpected advantages as herein described.

DESCRIPTION OF THE PREFERRED EMBODIMENTS

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

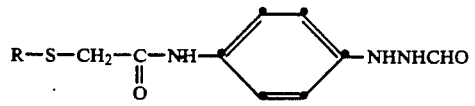

where R is an alkyl or cycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion and Process For Their Use", by J. J. Looker, R. E. Leone and L. J. Fleckenstein, filed Mar. 14, 1988 and issued Apr. 14, 1992, as U.S. Pat. No. 5,104,769. The disclosure of this application is incorporated herein by reference in its entirety.

The hydrazine compounds described in the aforesaid patent application Ser. No. 167,814 have one of the following structural formulae:

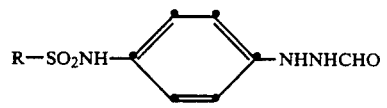

I or

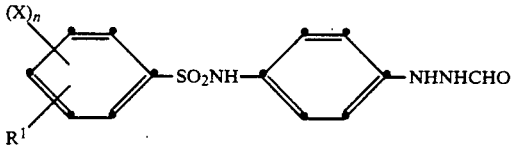

II wherein:

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2NR^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $—NHCOR^2$ or $—NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —$NHCOR^2$— or —$NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

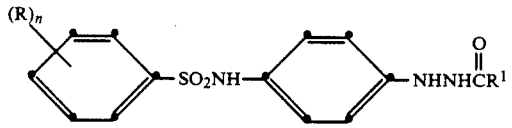

II where each R is a monovalent group comprised of at least three repeating ethyleneoxy units, n is 1 to 3, and $R^1$ is hydrogen or a blocking group.

These hydrazides are described in copending commonly assigned U.S. patent application Ser. No. 528,651, "High Contrast Photographic Element Including An Aryl Sulfonamidophenyl Hydrazide Containing Ethyleneoxy Groups", by H. I. Machonkin and D. L. Kerr, filed May 24, 1990 and issued Aug. 20, 1991, as U.S. Pat. No. 5,041,355, the disclosure of which is incorporated herein by reference in its entirety.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

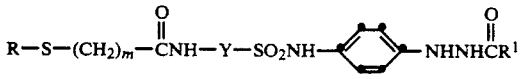

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

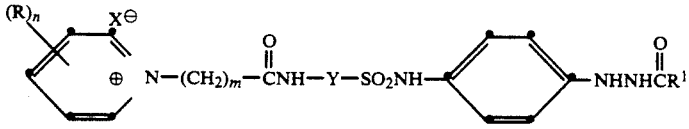

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

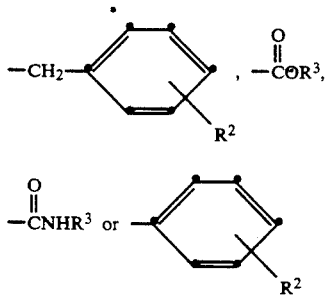

where $R^2$ is hydroxy or a hydroxy-substituted alkyl group having from 1 to 4 carbon atoms and $R^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016 4,914,003, 4,975,354, 4,988,604 and 4,994,365.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The nucleated high-contrast photographic elements of this invention utilize surface latent image forming high-chloride silver halide grains. By the term "high-chloride silver halide grains", as used herein, is meant silver halide grains in which at least the surface portion is composed of more than 50 mole percent silver chloride. Both conventional grains which are more than 50 percent silver chloride and grains of the core-shell type in which the shell is more than 50 percent silver chloride, can be employed with satisfactory results. Preferably, the silver halide grains utilized in this invention are at least 70 mole percent chloride. Use of high-chloride silver halide grains is highly advantageous in promoting the developability of the high contrast element, and thereby providing for the short development times that are critically needed in the field of graphic arts.

Preferably, the silver halide grains are monodispersed and have a mean grain size of not larger than about 0.7 micrometers, and more preferably of about 0.4 micrometers or less.

Typically, the silver laydown is in the range of from about 0.5 to about 10 grams per square meter, and preferably in the range of from about 2 to about 5 grams per square meter.

As described hereinabove, the silver halide grains utilized in this invention are capable of forming a surface latent image, as opposed to being of the internal latent image forming type. Thus, the silver halide emulsion layer is negative working. The silver halide grains can be of any suitable geometric form, e.g.,. regular cubic or octahedral crystalline forms. It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the high-chloride silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3.

M′ represents chromium, rhenium, ruthenium, osmium or iridium, and L′ represents one or a combination of halide and cyanide ligands or a combination of these ligands with up to two aquo ligands.

As an alternative to the use of a doping agent, an electron-accepting antifogging dye can be incorporated in the emulsion. Such dyes and their use in nucleated photographic elements are described in Gilman et al, U.S. Pat. No. 4,933,273.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

The high-contrast photographic elements of this invention can, optionally, contain, for the purpose of reducing pepper fog and controlling image spread, a thioether compound as described in copending commonly-assigned U.S. patent application Ser. No. 735,975 filed Jul. 25, 1991, "Nucleated High Contrast Photographic Elements Containing Thioether Compounds To Inhibit Pepper Fog And Restrain Image Spread", by H. I. Machonkin and D. L. Kerr. These are compounds which are free of both hydrazino and amino functionality and which:

(1) contain within their structure at least one thio (—S—) group, (2) contain within their structure a group comprised of at least three repeating ethyleneoxy units, and (3) have a partition coefficient (as hereinafter defined) of at least one. Preferred thioether compounds are those of the formula:

$$R-S-(CH_2CH_2O)_n-R'$$

wherein R and R' are monovalent organic radicals which can be the same or different and n is an integer with a value of from 3 to 50, and more preferably from 10 to 30.

As an alternative to the use of the thioether compounds described above, control of pepper fog and image spread can be achieved in this invention by the use of hydrophobic isothiourea compounds as described in copending commonly-assigned U.S. patent application Ser. No. 599,218, filed Oct. 17, 1990 and issued Jun. 30, 1992, as U.S. Pat. No. 5,126,227, "High Contrast Photographic Elements Containing Ballasted Hydrophobic Isothioureas", by Harold I. Machonkin and Donald L. Kerr, the disclosure of which is incorporated herein by reference.

These are compounds which have a partition coefficient (as hereinafter defined) of at least one and comprise a ballasting group, attached to the sulfur atom, which serves to restrict the mobility of the compound and thereby aid in retaining it in the photographic element during development. Preferred hydrophobic isothiourea compounds are those represented by the formula:

$$HN{=}\underset{\underset{NH_2}{|}}{C}-S-R$$

wherein R is a ballasting group that contains at least six carbon atoms and is substantially free of solubilizing groups.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines.

The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

$$\begin{array}{ccc} R_1 & & R_3 \\ \diagdown & & \diagdown \\ & N-(CH_2CH_2O)_n-CH_2-CH_2-N & \\ \diagdown & & \diagdown \\ R_2 & & R_4 \end{array}$$

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula:

$$R-\overset{\overset{H}{|}}{N}-(CH_2CH_2O)_n-CH_2-CH_2-\overset{\overset{H}{|}}{N}-R$$

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

$$\begin{array}{ccc} Pr & & Pr \\ \diagdown & & \diagdown \\ & N-(CH_2CH_2O)-CH_2CH_2-N & \\ \diagdown & \sim 14 & \diagdown \\ Pr & & Pr \end{array}$$

where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

$$\begin{array}{c} R^2 \\ \diagdown \\ N-A\text{-}(X)_n\text{-}R^4 \\ \diagup \\ R^3 \end{array}$$

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents $-CONR^5-$, $-O-CONR^5$, $-NR^5CONR^5-$, $-NR^5COO-$, $-COO-$, $-OCO-$, $-CO-$, $-NR^5CO-$, $-SO_2NR^5-$, $-NR^5SO_2-$, $-SO_2-$, $-S-$ or $-O-$ group in which $R^5$ represents a hydrogen atom or a lower alkyl group and n represents 0 or 1, with the proviso that the total number of carbon atoms contained in $R^2$, $R^3$, $R^4$ and A is 20 or more.

The amino compound utilized as an incorporated booster is typically employed in an amount of from about 0.1 to about 25 millimoles per mole of silver, and more preferably in an amount of from about 0.5 to about 15 millimoles per mole of silver.

The high-contrast photographic elements of this invention can, optionally, contain a combination of a gold compound and a urea compound as described in copending commonly-assigned U.S. patent application Ser. No. 735,979, filed Jul. 25, 1991, "Nucleated High Contrast Photographic Elements Containing Urea Compounds Which Enhance Speed And Increase Contrast", by Anthony Adin. Urea compounds described in this copending patent application are 1,1,3,3-tetra-substituted middle chalcogen urea compounds, in which at least one substituent comprises a nucleophilic center. When used in combination with a gold compound, these urea compounds serve as very effective chemical sensitizers, providing increased speed and increased toe contrast without a concurrent increase in fog.

Gold compounds useful as chemical sensitizers in this invention include:

gold chloride,
gold sulfide,
gold iodide,
potassium tetrachloroaurate,
potassium aurothiocyanate,
aurous dithiosulfate
and the like.

A preferred class of gold compounds for use as chemical sensitizers in this invention are the gold (I) compounds described in copending, commonly assigned U.S. patent application Ser. No. 614,536 filed Nov. 16, 1990 and issued Sep. 17, 1991, as U.S. Pat. No. 5,049,485, "Photographic Silver Halide Material Comprising Gold Compound", by J. C. Deaton, the disclosure of which is incorporated herein by reference. These are compounds of the formula:

$$AuL_2^+X^- \text{ or } AuL(L^1)^+X^-$$

wherein
L is a mesoionic compound;
X is an anion; and
$L^1$ is a Lewis donor ligand.

Preferably L is represented by the formula:

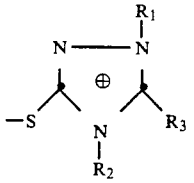

wherein $R_1$, $R_2$ and $R_3$ individually are hydrogen or a hydrocarbon group.

A particularly preferred species is aurous bis(1,4,5-trimethyl-1,2,4-triazolium-3-thiolate) tetrafluoroborate, which has the formula:

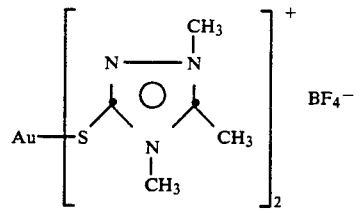

A second preferred class of gold compounds for use as chemical sensitizers in this invention are the gold (I) compounds described in copending commonly assigned U.S. patent application Ser. No. 614,537, filed Nov. 16, 1990 and issued Sep. 17, 1991, as U.S. Pat. No. 5,049,484, "Photographic Silver Halide Material and Process", by J. C. Deaton, the disclosure of which is incorporated herein by reference. These are compounds of the formula:

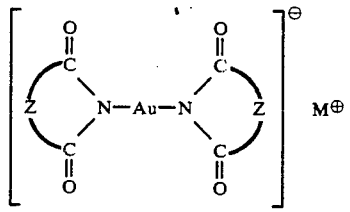

wherein Z represents the substituted or unsubstituted nitrogen and carbon atoms necessary to complete a 5-or 6 member imide nucleus; and M is a cation, preferably sodium, tetraethyl ammonium or potassium. The protonated form of the imide nucleus preferably has a pKa in the range of 7 to 12, and more preferably 8 to 11.

Z is preferably

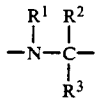

wherein $R^1$, $R^2$ and $R^3$ individually are hydrogen or a hydrocarbon group, preferably a substituted or unsubstituted hydrocarbon group containing 1 to 15 carbon atoms, such as an alkyl group, for example, methyl, ethyl, propyl, n-butyl and t-butyl, and octyl groups, or phenyl groups. $R^3$ is preferably hydrogen.

A particularly preferred species is bis(1-methylhydantoinato) gold (I) sodium salt, which has the formula:

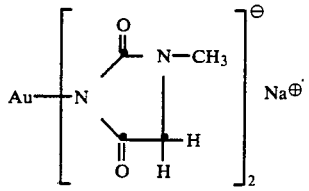

The urea compounds optionally utilized as chemical sensitizers in this invention are described in Burgmaier, U.S. Pat. No. 4,810,626 issued Mar. 7, 1989, the disclosure of which is incorporated herein by reference. These are 1,1,3,3-tetrasubstituted middle chalcogen urea compounds, wherein at least one substituent comprises a nucleophilic center. They can be represented by the formula:

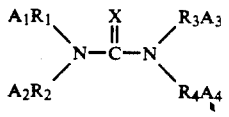

wherein

X is a middle chalcogen atom, i.e., a Group VI A atom below oxygen and above polonium;

each of $R_1$, $R_2$, $R_3$ and $R_4$ independently can represent an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5 to 7 member heterocyclic ring; and each of $A_1$, $A_2$, $A_3$ and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains the nucleophilic group bonded to a urea nitrogen atom through a 2 or 3 member chain.

Sulfur is the preferred Group VI A atom due to ready availability of starting materials for thiourea synthesis and greater solubility of the thiourea compound in aqueous solutions where silver halide sensitization occurs.

The term "nucleophilic group", as employed herein, refers to an atom such as an oxygen atom of oxygen acids, a sulfur atom of sulfur acids and a nitrogen atom of nitrogen acids or of a primary or secondary amine. Such nucleophilic groups comprise carboxylic (—COOH), sulfinic (—$SO_2H$), sulfonic (—$SO_3H$), hydroxamic (—NHOH), mercaptan (—SH), sulfonamido (—$SO_2NH$—) and primary and secondary amines.

Inorganic or organic salts of these acids are equally useful.

Preferably, at least one of $R_1A_1$ to $R_4A_4$ is an omega-bound methyl or ethyl carboxylic acid or a salt thereof.

Other than a nucleophilic group as defined above, which is necessary for successful chemical sensitization of silver halide and which is attached to the urea nitrogen through a two or three member chain, the composition of the remaining RA groups on the 1,1,3,3-tetrasubstituted urea compound can vary widely for achieving the desired chemical sensitization of silver halides.

Alkylene groups which can be represented by at least one of $R_1$ to $R_4$ which are not bonded to the required nucleophilic group can contain from 1 to 6 carbon atoms, preferably from 1 to about 4 carbon atoms for greater solubility properties.

When the $R_1$ to $R_4$ groups are cycloalkylene, the ring portion can contain from about 3 to about 8, preferably about 5 or 6 carbon atoms. Where a cycloalkylene group has the required nucleophilic group bonded thereto, it is important for successful operation of this invention that such group be bonded to one of the urea nitrogen atoms through a 2 or 3 member chain.

Where one of the $R_1$ to $R_4$ groups is an aromatic heterocyclic or an aromatic carbocyclic ring, such ring system can comprise from about 5 to about 10 atoms in the ring, such as for example pyrrole, phenyl, naphthyl, pyridinyl, quinolyl and naphthryl. When the aromatic heterocyclic or aromatic carbocyclic group has bonded thereto the required nucleophilic group, the chain separating the nucleophilic group from a urea nitrogen atom comprises from 2 to 3 members.

Where an $R_1$ to $R_4$ group is an alkarylene or aralkylene, the alkylene moiety thereof can comprise from about 1 to about 3 carbon atoms and the aryl portion is an aromatic group as described above. When the required nucleophilic group is bonded to an aralkylene group, the chain separating the nucleophilic group from a urea nitrogen atom comprises from 2 to 3 atoms.

Heterocyclic rings which can be formed by a urea nitrogen atom with $R_1$ and $R_2$ or with $R_3$ and $R_4$ can comprise 5 or 6 ring members. Typical heterocyclic rings so formed include pyridine, morpholine, piperdine and diazine.

The urea compound is typically employed in this invention in an amount of from about 0.001 to about 10 millimoles per mole of silver, and preferably in an amount of from about 0.003 to about 0.04 millimoles per mole of silver. The gold compound is typically employed in an amount of from about 0.0001 to about 10 millimoles per mole of silver, and preferably in an amount of from about 0.0005 to about 0.04 millimoles per mole of silver. Preferably the molar ratio of the urea compound to the gold compound is greater than one.

In addition to the combination of a gold compound and a urea compound used as a chemical sensitizer, an additional chemical sensitizer which is a mercury compound can be employed. In particular, mercury compounds such as bis(2-amino-5-iodopyridine-dihydroiodide) mercuric iodide are effective in reducing R-typing.

As hereinabove described, the sensitizing dyes employed in this invention are benzimidazolocarbocyanine sensitizing dyes having at least one acid-substituted alkyl group attached to a nitrogen atom of a benzimidazole ring and preferably having the formula:

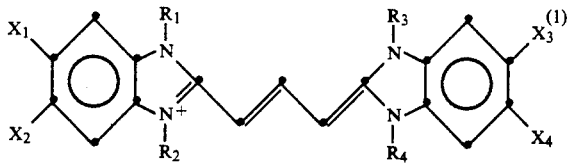

(1)

wherein $X_1$, $X_2$, $X_3$, $X_4$, $R_1$, $R_2$, $R_3$ and $R_4$ are as defined hereinabove.

Preferably, no two of $X_1$ to $X_4$ are halo at the same time. The reason for this preference is that the benzimidazolocarbocyanine dyes in which no two of $X_1$ to $X_4$ are halo at the same time are especially effective at avoiding dye stain, and function as spectral sensitizers at moderate wavelengths so as to provide excellent safelight performance.

In a particularly preferred embodiment of this invention, the substituents $X_1$–$X_4$ and $R_1$–$R_4$ are chosen to fit equation (i) as follows:

$$0.455\Sigma\sigma_i(R_1\text{–}R_4)+0.144\Sigma\sigma_p(X_1\text{–}X_4)+0.610\geqq 0.68 \quad \text{(i)}$$

where the small sigmas are electronic substituent constants, $\sigma_i$ being Taft's sigma (inductive) constant, and $\sigma_p$ being Hammett's sigma (para) constant. Values for the above constants and a discussion of their meaning can be found in Hansch and Leo, Substituent Constants for Correlation Analysis in Chemistry and Biology. Dyes of formula (1) which fit equation (i) have low fog and excellent keeping properties.

In a further particularly preferred embodiment of the invention, one but not both of $X_1$ and $X_3$ is a chlorine atom. These dyes show unexpectedly superior photographic speed and sensitivity compared to other dyes of structure (1).

Hydrophilic substituents on the benzimidazolocarbocyanine dyes of this invention are especially beneficial to further minimize dye stain. In choosing between substituents having similar sigma constants, the substituent with the more negative hydrophobicity parameter (pi) is preferred. Values for "pi" constants are available in Hansch and Leo, referred to hereinabove. For example, the hydroxyethyl substituent ($\sigma_i$=0.0, pi=−0.77) is preferred over the allyl substituent ($\sigma_i$=0.0, pi=+1.10) to further insure low stain. The reason that lower stain is achieved is decreased gel binding for the more hydrophilic dye.

Specific examples of sensitizing dyes useful in this invention are provided in Table I below:

TABLE I

| Dye | $X_1$ | $X_2$ | $X_3$ | $X_4$ | $R_1$ | $R_2$ | $R_3$ | $R_4$ | Value from Eqn. (i) |
|---|---|---|---|---|---|---|---|---|---|
| 1-1 | H | CF3 | Cl | CF3 | Me | 3SB | Et | TFE | 0.776 |
| 1-2 | H | CF3 | Cl | CF3 | Me | 3SB | Et | Allyl | 0.712 |
| 1-3 | H | CF3 | Cl | CF3 | Me | TFE | Et | 3SP | 0.776 |
| 1-4 | H | CF3 | Cl | CF3 | Me | 3SB | Et | Et | 0.689 |
| 1-5 | H | CF3 | Cl | CF3 | Me | 3SB | Et | Et | 0.689 |
| 1-6 | Cl | CF3 | Cl | CF3 | Et | Et | Et | 3SP | 0.718 |
| 1-7 | H | CF3 | H | CF3 | Et | DMCM | Me | 3SP | 0.702 |
| 1-8 | H | CF3 | H | CF3 | Et | iPCM | Me | 3SP | 0.738 |
| 1-9 | H | CF3 | H | CF3 | Et | ECM | Me | 3SP | 0.738 |
| 1-10 | H | CF3 | H | CF3 | Et | TFE | Me | 3SP | 0.743 |
| 1-11 | H | CF3 | H | CF3 | Et | TFE | Me | 3SP | 0.743 |
| 1-12 | H | CF3 | H | CF3 | Me | TFE | Me | 3SP | 0.747 |
| 1-13 | H | CF3 | H | CF3 | Et | SECM | Me | 3SP | 0.702 |
| 1-14 | H | CF3 | H | CF3 | Et | TFE | Et | 3SP | 0.738 |
| 1-15 | H | CF3 | Cl | CF3 | Me | 3SB | Et | HOEt | 0.712 |
| 1-16 | H | CF3 | Cl | CF3 | Me | HOEt | Et | 3SP | 0.712 |
| 1-17 | Me | Me | Cl | Cl | Et | Et | Et | 3SP | 0.510 |
| 1-18 | H | Cl | H | CF3 | Me | 3SP | Me | Et | 0.620 |
| 1-19 | H | CF3 | H | CF3 | Me | Et | Et | 3SP | 0.660 |

H = hydrogen, CF3 = trifluoromethyl, Cl = chloro, Me = methyl, SB = 3-sulfobutyl, Et = ethyl, TFE = 2,2,2-trifluoroethyl, 3SP = 3-sulfopropyl, DMCM = dimethylcarbamoylmethyl, iPCM = iosopropoxycarbonylmethyl, ECM = ethoxycarbonylmethyl, SECM = 2-sulfoethylcarbamoylmethyl, HOEt = hydroxyethyl.

The benzimidazolocarbocyanine dyes utilized in this invention can be synthesized using techniques that are well-known in the art, such as described in Hamer, *Cyanine Dyes and Related Compounds,* 1964, and James, *The Theory of the Photographic Process,* 4th Edition, 1977.

An illustrative synthesis is that for Dye 1-2, which was carried out as follows:

Anhydro-2-acetanilidovinyl-1-methyl-3-(3-sulfobutyl)-5-trifluoromethylbenzimidazolium hydroxide (2.47 g, 0.005 mole) and 3-allyl-6-chloro-1-ethyl-2-methyl-5-trifluoromethylbenzimidazolium bromide (1.92 g, 0.005 mole) were suspended with stirring in 15 mL of acetonitrile. 1,8-Diazabicyclo[5.4.0]undec-7-ene (0.80 mL, 0.0054 mole) was added. The mixture was heated to reflux for 10 minutes in a 100 degrees C. oil bath. After cooling, dye 1-2 precipitated and was collected by filtration. The orange solid was recrystallized from 30 mL of acetonitrile. Wt. −1.09 g, 33% yield, λmax (methanol)=500 nm, εmax=153,000 L/mole-cm.

Calculated for: $C_{29}H_{29}ClF_6N_4O_3S$ 0.5 $H_2O$ 47.10%C, 3.81%H, 7.85%N.

Found: 46.93%C, 3.80%H, 7.82%N.

The sensitizing dyes described herein are preferably utilized in this invention in amounts of from about 0.1 to about 1 millimoles per mole of silver, and more preferably in an amount of from about 0.2 to about 0.6 millimoles per mole of silver.

In preparing the photographic elements of this invention, the sensitizing dye can be added to the emulsion in accordance with well known techniques, for example, by dissolving in organic solvents or dispersing in water or water/gelatin mixtures. To facilitate adding the dye to the emulsion, the solubility of the dye can be temporarily increased by protonation with an equivalent amount of an acid, such as hydrochloric acid.

If desired, sensitizing dyes other than the above-described benzimidazolocarbocyanine sensitizing dyes can also be added to the photographic emulsion. Such sensitizing dyes include the cyanines, merocyanines, complex cyanines and merocyanines, oxonols, hemioxonols, styryls, merostyryls and streptocyanines.

Use of 5,5',6,6'-tetrachloro-1,1',3,3'-tetraethylbenzimidazolocarbocyanine iodide as a sensitizing dye in high contrast photographic elements of the type described herein is disclosed at Column 15, line 48, of U.S. Pat. No. 4,975,354. However, this dye has a value of 0.652 as calculated by Equation (i) herein, and will stain in rapid access processing due to the absence of an acid-substituted alkyl group. Also, since all of the $X_1$–$X_4$ substituents are chlorine atoms, this dye will sensitize at longer wavelengths and limit safelight tolerance.

The term "partition coefficient", as used herein, refers to the log P value of the compound with respect to the system n-octanol/water as defined by the equation:

$$\log P = \log \frac{[X]_{octanol}}{[X]_{water}}$$

where X=concentration of the compound. The partition coefficient is a measure of the ability of a compound to partition between aqueous and organic phases and is calculated in the manner described in an article by A. Leo, P. Y. C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media, and a compound with a log P of two is one hundred times more soluble in organic media than in aqueous media.

The invention is further illustrated by the following examples of its practice. In these examples, reference is made to emulsion addenda having structures as indicated below:

CS-1
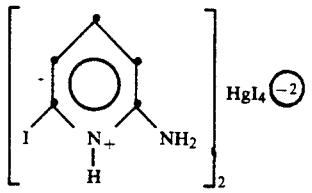
CS-2
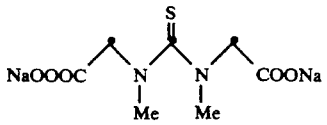
$KAuCl_4$
CS-3
A-1
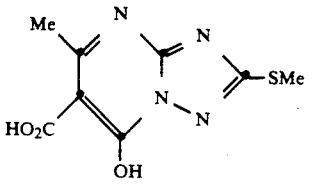
A-2
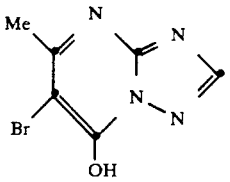
A-3
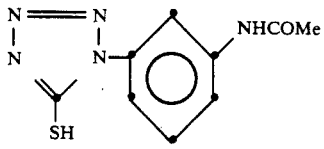
A-4
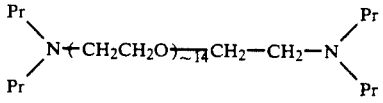
A-5
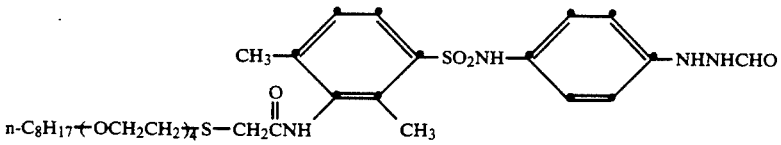
The examples also refer to sensitizing dyes $S_1$, $S_2$ and $S_3$ of a structure outside the scope of the present invention. Dyes $S_1$, $S_2$ and $S_3$ are green sensitizing dyes, of known utility for graphic arts films and papers, having structures as follows:
S-1
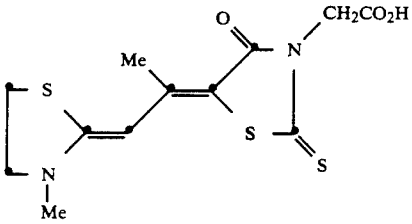
-continued
S-2
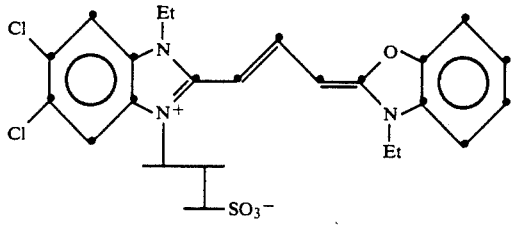

-continued

S-3

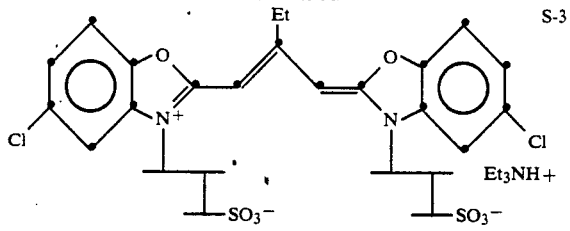

In the formulae given above, "Me" represents methyl, "Et" represents ethyl, and "Pr" represents n-propyl.

EXAMPLE 1

A 0.24 micron edge length, rhodium-doped (0.015 mg Rh/mole Ag) cubic silver chloride emulsion was chemically sensitized using 0.14 mg/Ag mole CS-1, 1.3 mg/Ag mole CS-2, and 1.2 mg/Ag mole CS-3. The emulsion was then dyed with 1/3 millimole/Ag mole of sensitizing dye, and held for 20 minutes before 400 mg/Ag mole A-1, 200 mg/Ag mole A-2, 50 mg/Ag mole A-3, 2 g/Ag mole A-4, and 0.2 mM/Ag mole A-5 were added. After addition of a latex polymer (a copolymer of methyl acrylate, 2-acrylamido-2-methylpropane sulfonic acid and 2-acetoacetoxy-ethylmethacrylate), the emulsions were coated on a polyester support to give a silver laydown of 3.44 g/sq-m, a gel laydown of 2.69 g/sq-m, and a latex polymer laydown of 1.29 g/sq-m. The emulsion layers were overcoated with 0.88 g/sq-m of gel, and hardened with 2 wt % bis-vinylsulfonylmethane with respect to the total gelatin.

The films were exposed for 0.5 seconds by a 3000° K. tungsten source through a continuous wedge target, and developed for 35 seconds at 35° C.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to four parts of water to produce a working strength developing solution with a pH of 10.5.

The photographic speeds (100×Log spectral sensitivity) of the films were measured at 0.1 and 4.0 density units above fog. The slopes of the lines joining the density points of 0.1 and 0.6 above fog (toe contrast) were also recorded. The results are listed in Table II.

TABLE II

| Dye | Level (mg/mole Ag) | Speed at 0.1 above fog | Speed at 4.0 above fog | Toe Contrast | Comments |
|---|---|---|---|---|---|
| 1-12 | 204 | 198 | 176 | 11.6 | No stain |
| S-1 | 200 | 191 | 129 | 8.1 | No Stain |
| S-2 | 170 | 207 | 186 | 11.8 | Stain |

The data in Table II show that the dye of this invention (Dye 1-12) provides excellent speed and contrast with no residual stain after processing. Dyes S-1 and S-2 which also adsorb to high chloride emulsions are deficient, either producing low contrast in the case of Dye S-1, or objectionable stain in the case of Dye S-2.

EXAMPLE 2

A similar set of coatings was prepared using the same coating format, exposure, and processing conditions as in Example 1, except that the edge length was 0.26 microns and the rhodium content was 0.010 mgRh/mole Ag. In this case, the coatings were compared 24 hours after coating and again after storage at 50° C. for one week. The initial speed (100×Log sensitivity) at 0.1 and 4.0 density was recorded, and the change in speed after the one week incubation was determined. The results are shown in Table III.

TABLE III

| Dye | Level (mg/mole Ag) | 0.1 Speed | 4.0 Speed | Toe Contrast | Change in 0.1 Speed | Change in 4.0 Speed | Change in Toe Contrast |
|---|---|---|---|---|---|---|---|
| 1-12 | 204 | 207 | 186 | 16 | +7 | +1 | −3.7 |
| S-2 | 170 | 220 | 196 | 11.7 | −4 | −42 | −4.8 |
| S-3 | 216 | 161 | 140 | 12 | +30 | −54 | −3 |

The data in Table III show that the dye of this invention (Dye 1-12) provides better keeping than the two comparison dyes. Dye S-3 provides low post-process stain, but it does not adsorb well to high-chloride emulsions, resulting in lower speed and greater incubation changes. Dye S-2 has the disadvantage that it causes objectionable stain.

EXAMPLE 3

A set of coatings was prepared using a coating format similar to Example 1, except for the following changes: the edge length of the emulsion was 0.23 micron, the rhodium content was 0.0094 mg Rh/mole Ag, the level of A-5 was increased to 0.4 mmole/mole Ag, and the development time was shortened from 35 seconds to 30 seconds. Again, the speed (100×Log sensitivity) at 0.1 density above fog was recorded. The strips were incubated at 50° C. for one week, and the change in the 0.1 speed was recorded. The calculation of values for equation (i) were carried out with the following values for the substituents: $\sigma_i$ for Me (−0.04), Et (−0.05), SP (−0.1), 3-SB(−0.1), allyl (0.0), TFE (+0.14); and $\sigma_p$ for Me (−0.17), H (0.0), Cl (+0.23), CF3 (+.54). The results are shown in Table IV.

TABLE IV

| Dye | Value from Equation (i) | 0.1 Speed | Change in 0.1 Speed |
|---|---|---|---|
| 1-17 | 0.510 | 240 | +54 |
| 1-18 | 0.620 | 224 | +52 |
| 1-19 | 0.660 | 227 | +46 |
| 1-5 | 0.689 | 238 | +27 |

TABLE IV-continued

| Dye | Value from Equation (i) | 0.1 Speed | Change in 0.1 Speed |
|---|---|---|---|
| 1-2 | 0.712 | 241 | +38 |
| 1-12 | 0.747 | 223 | +22 |
| 1-1 | 0.776 | 228 | +26 |

The data in Table IV show that all of the dyes provide excellent photographic speed, but those dyes with values less than 0.68 from equation (i) give much larger and less desirable speed changes with incubation of the coatings. Thus, it is particularly preferred in this invention to utilize a sensitizing dye which has a value as calculated by Equation (i) of at least 0.68.

EXAMPLE 4

A set of coatings was prepared, exposed, and processed as in Example 3. The photographic speeds and toe contrast were measured as before. The results are listed in Table V.

TABLE V

| Dye | 0.1 Speed | 4.0 Speed | Toe Contrast |
|---|---|---|---|
| 1-12 | 217 | 194 | 13.3 |
| 1-5 | 233 | 210 | 12.5 |
| 1-4 | 234 | 211 | 14.0 |
| 1-3 | 222 | 200 | 12.9 |
| 1-1 | 222 | 200 | 12.2 |
| 1-2 | 235 | 213 | 12.1 |

The data in Table V show that those dyes of formula (1) where $X_1$ or $X_3$ is a chlorine atom (1-1 to 1-5) provide greater photographic speed than the dye (1-12) in which neither $X_1$ nor $X_3$ is a chlorine atom. This phenomenon is observed for all dyes in Table I which contain a chlorine substituent at $X_1$ or $X_3$. Thus, it is particularly preferred in this invention that $X_1$ or $X_3$ be chlorine.

As shown by the examples provided hereinabove, the photographic elements of this invention provide excellent results when processed in a conventional developing solution at a moderate temperature of 35° C. and with a short processing time of only 30 to 35 seconds. The combination of high-chloride silver halide grains, a hydrazine compound that functions as a nucleator, an amino compound that functions as a booster and a sensitizing dye of the structure hereinabove described, provides high photographic speed, very high contrast, rapid-access processing capability and little or no dye stain.

The invention has been described in detail with particular reference to preferred embodiments thereof, but it will be understood that variations and modifications can be effected within the spirit and scope of the invention.

What is claimed is:

1. A silver halide photographic element adapted to form a high contrast image when developed with an aqueous alkaline developing solution; said element comprising:

(1) surface latent image forming high-chloride silver halide grains, (2) a hydrazine compound that functions as a nucleator, (3) an amino compound that functions as an incorporated booster, and (4) a benzimidazolocarbocyanine sensitizing dye; said benzimidazolocarbocyanine sensitizing dye having the formula:

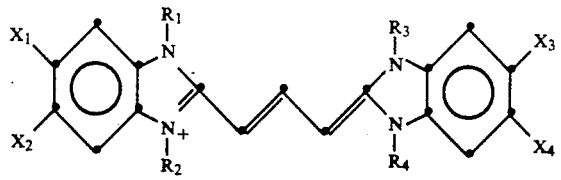

and satisfying the following equation:

$$0.455\Sigma\sigma_i(R_1-R_4)+0.144\Sigma\sigma_p(X_1-X_4)+0.610\geqq 0.68$$

wherein $X_1$, $X_2$, $X_3$ and $X_4$ are independently, hydrogen, cyano, alkyl, halo, haloalkyl, alkylthio, alkoxycarbonyl, aryl, carbamoyl or substituted carbamoyl;

$R_1$ and $R_3$ are alkyl;

$R_2$ and $R_4$ are independently, alkyl, alkenyl, substituted alkyl or substituted alkenyl with the proviso that at least one of $R_2$ and $R_4$ is acid-substituted alkyl and with the further proviso that when both $R_2$ and $R_4$ are acid-substituted alkyl, there is also a cation present to balance the charge;

$\sigma_i$ is Taft's sigma inductive constant and $\sigma_p$ is Hammett's sigma para constant.

2. A silver halide photographic element as claimed in claim 1 wherein $R_1$ and $R_3$ are alkyl groups of 1 to 6 carbon atoms.

3. A silver halide photographic element as claimed in claim 1 wherein $R_1$ and $R_3$ are, independently, methyl or ethyl.

4. A silver halide photographic element as claimed in claim 1 wherein no two of $X_1$ to $X_4$ are halo at the same time.

5. A silver halide photographic element as claimed in claim 1 wherein one but not both of $X_1$ and $X_3$ is chloro.

6. A silver halide photographic element as claimed in claim 1 wherein at least one of $R_2$ and $R_4$ is 2-sulfoethyl, 3-sulfopropyl, 3-sulfobutyl or 4-sulfobutyl.

7. A silver halide photographic element as claimed in claim 1 wherein $X_1$ is hydrogen, $X_2$ is trifluoromethyl, $X_3$ is chloro, $X_4$ is trifluoromethyl, $R_1$ is methyl, $R_2$ is 3-sulfobutyl, $R_3$ is ethyl and $R_4$ is 2,2,2-trifluoroethyl.

8. A silver halide photographic element as claimed in claim 1 wherein $X_1$ is hydrogen, $X_2$ is trifluoromethyl, $X_3$ is chloro, $X_4$ is trifluoromethyl, $R_1$ is methyl, $R_2$ is 3-sulfobutyl, $R_3$ is ethyl and $R_4$ is allyl.

9. A silver halide photographic element as claimed in claim 1 wherein $X_1$ is hydrogen, $X_2$ is trifluoromethyl, $X_3$ is chloro, $X_4$ is trifluoromethyl, $R_1$ is methyl, $R_2$ is 2,2,2-trifluoroethyl, $R_3$ is ethyl and $R_4$ is 3-sulfopropyl.

10. A silver halide photographic element as claimed in claim 1 wherein $X_1$ is hydrogen, $X_2$ is trifluoromethyl, $X_3$ is chloro, $X_4$ is trifluoromethyl, $R_1$ is methyl, $R_2$ is 3-sulfopropyl, $R_3$ is ethyl, and $R_4$ is ethyl.

11. A silver halide photographic element as claimed in claim 1 wherein $X_1$ is hydrogen, $X_2$ is trifluoromethyl, $X_3$ is chloro, $X_4$ is trifluoromethyl, $R_1$ is methyl, $R_2$ is 3-sulfobutyl, $R_3$ is ethyl and $R_4$ is ethyl.

12. A silver halide photographic element as claimed in claim 1 wherein $X_1$ is hydrogen, $X_2$ is trifluoromethyl, $X_3$ is hydrogen, $X_4$ is trifluoromethyl, $R_1$ is methyl, $R_2$ is 2,2,2-trifluoroethyl, $R_3$ is methyl and $R_4$ is 3-sulfopropyl.

13. A silver halide photographic element as claimed in claim 1 wherein $X_1$ is hydrogen, $X_2$ is trifluoromethyl, $X_3$ is chloro, $X_4$ is trifluoromethyl, $R_1$ is methyl, $R_2$ is 3-sulfobutyl, $R_3$ is ethyl and $R_4$ is 2-hydroxyethyl.

14. A silver halide photographic element as claimed in claim 1 wherein said silver halide grains are at least 70 mole per cent silver chloride.

15. A silver halide photographic element as claimed in claim 1 wherein said silver halide grains have a mean grain size of about 0.4 micrometers or less.

16. A silver halide photographic element as claimed in claim 1 wherein said silver halide grains include a doping agent which enhances contrast.

17. A silver halide photographic element as claimed in claim 1 wherein said silver halide grains are rhodium-doped.

18. A silver halide photographic element as claimed in claim 1 wherein said hydrazine compound is an aryl sulfonamidophenyl hydrazide of the formula:

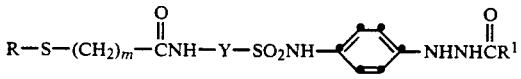

where R is monovalent group comprised of at least three repeating ethyleneoxy units, m is 1 to 6, Y is a divalent aromatic radical, and $R^1$ is hydrogen or a blocking group.

19. A silver halide photographic element as claimed in claim 1 wherein said amino compound is a compound which (1) comprises at least one secondary or tertiary amino group, (2) contains within its structure a group comprised of at least three repeating ethyleneoxy units, and (3) has a partition coefficient of at least one.

20. A silver halide photographic element as claimed in claim 1 wherein said amino compound is a bis-tertiary amine of the formula:

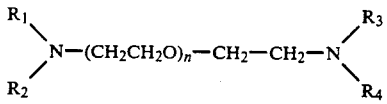

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

21. A silver halide photographic element as claimed in claim 1 wherein said amino compound is a bis-secondary amine of the formula:

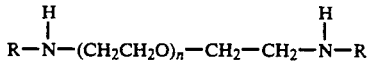

wherein n is an integer with a value of 3 to 50 and each R is independently a linear or branched, substituted or unsubstituted alkyl group of at least 4 carbon atoms.

22. A silver halide photographic element as claimed in claim 1, additionally comprising a gold compound and a 1,1,3,3-tetra-substituted middle chalcogen urea compound in which at least one substituent comprises a nucleophilic center.

23. A silver halide photographic element as claimed in claim 1 wherein the amount of said sensitizing dye is from about 0.1 to about 1 millimole per mole of silver.

24. A silver halide photographic element adapted to form a high contrast image when developed with an aqueous alkaline developing solution, said element comprising;

(1) surface latent image forming rhodium-doped high-chloride silver halide grains, (2) a hydrazine compound that functions as a nucleator, said hydrazine compound having the formula:

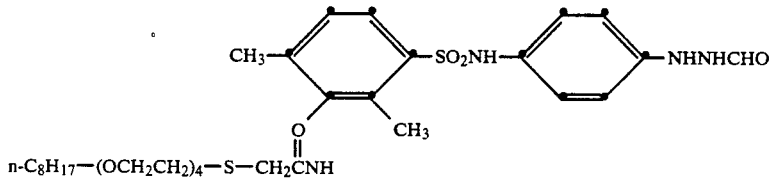

(3) an amino compound that functions as an incorporated booster, said amino compound having the formula:

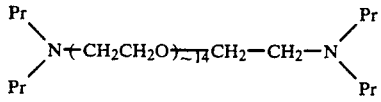

where Pr represents n-propyl, (4) potassium tetrachloroaurate in an amount sufficient to serve as a chemical sensitizer, (5) 1,3-dicarboxymethyl-1,3-dimethyl-2-thiourea in an amount sufficient to serve as a chemical sensitizer, and (6) as a sensitizing dye, the benzimidazolocarbocyanine dye of the formula:

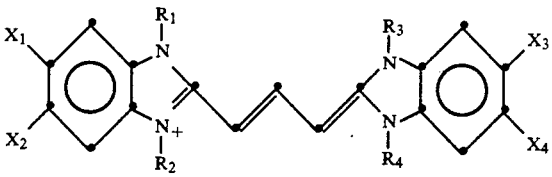

wherein $X_1$ is hydrogen, $X_2$ is trifluoromethyl, $X_3$ is chloro, $X_4$ is trifluoromethyl, $R_1$ is methyl, $R_2$ is 3-sulfobutyl, $R_3$ is ethyl and $R_4$ is 2-hydroxyethyl.

* * * * *